US007926859B2

(12) United States Patent
St. Germain

(10) Patent No.: US 7,926,859 B2
(45) Date of Patent: Apr. 19, 2011

(54) SYNTHETIC SLING WHOSE COMPONENT PARTS HAVE OPPOSING LAYS

(75) Inventor: George Frederick Dennis St. Germain, Chadds Ford, PA (US)

(73) Assignee: Slingmax, Inc., Aston, PA (US)

( * ) Notice: Subject to any disclaimer, the term of this patent is extended or adjusted under 35 U.S.C. 154(b) by 470 days.

(21) Appl. No.: 12/082,591

(22) Filed: Apr. 11, 2008

(65) Prior Publication Data

US 2009/0108603 A1 Apr. 30, 2009

Related U.S. Application Data

(63) Continuation-in-part of application No. 11/981,110, filed on Oct. 31, 2007, now Pat. No. 7,568,333.

(51) Int. Cl.
*B66C 1/12* (2006.01)

(52) U.S. Cl. ..... 294/74; 57/231

(58) Field of Classification Search ..... 57/3, 6, 57/12, 13, 21, 201, 204, 224, 231; 294/74
See application file for complete search history.

(56) References Cited

U.S. PATENT DOCUMENTS

| | | | | |
|---|---|---|---|---|
| 3,481,134 | A * | 12/1969 | Whewell, Jr. | 57/12 |
| 3,899,206 | A * | 8/1975 | Miura | 294/74 |
| 4,124,244 | A * | 11/1978 | Bryant | 294/74 |
| 4,354,704 | A | 10/1982 | Mayerjak | 294/74 |
| 4,843,807 | A | 7/1989 | Von Danwitz | 57/201 |
| 5,333,442 | A * | 8/1994 | Berger | 57/314 |
| 5,415,449 | A * | 5/1995 | Kentner, Sr. | 294/74 |
| 5,649,414 | A | 7/1997 | Rawdon et al. | 57/201 |
| 7,127,878 | B1 * | 10/2006 | Wilke et al. | 57/231 |

FOREIGN PATENT DOCUMENTS

| | | |
|---|---|---|
| DE | 27 16 056 | 10/1978 |
| EP | 0 281 287 | 9/1988 |
| JP | 59125990 | 7/1984 |

OTHER PUBLICATIONS

McKenna, H A, Hearle, J W S, O'Hear, N. "Handbook of fibre rope technology" 2004. pp. 77-80.

* cited by examiner

*Primary Examiner* — Dean J Kramer
(74) *Attorney, Agent, or Firm* — Stradley Ronon Stevens & Young, LLP; Law Offices of Mark A. Garzia, P.C.

(57) ABSTRACT

A sling for industrial lifting made of a load-bearing core and a cover. The cover protects the plurality of yarns that make-up the core. Each core yarn is made of a number of core threads twisted together. The core yarns are twisted together where the twist is in the same direction as the individual core strands and a different direction than the twist of the cover. The present invention describes the method of twisting the core yarns together by inserting core yarns substantially parallel into a cover that has a twist opposite of each core strand. As the core strands are inserted into the cover, the twists of the individual core yarns interact with the twist of the cove, resulting in the core yarns twisting together.

5 Claims, 3 Drawing Sheets

SYNTHETIC SLING WHOSE COMPONENT PARTS HAVE OPPOSING LAYS

CROSS-REFERENCE TO RELATED APPLICATION

The present application is a continuation-in-part and claims the benefit under any applicable U.S. statute to U.S. application Ser. No. 11/981,110 filed Oct. 31, 2007, in the name of Dennis St. Germain, titled Apparatus for Making Slings.

This application incorporates by reference U.S. application Ser. No. 11/981,110 as if fully set forth herein.

FIELD OF THE INVENTION

The present invention relates generally to industrial slings and, more particularly, to the relationship between the load-bearing core and protective covers for non-metal slings.

BACKGROUND OF THE INVENTION

Industrial slings used in rigging or to lift, load, tow and/or move heavy loads are well-known in the art. At one time, industrial slings were made exclusively of wire-rope or chains. During the past twenty-five years, these industrial slings made of metal have seen improvements in flexibility and strength. However, despite the improvements, metal wire-rope slings still do not have the flexibility of non-metal (or synthetic) slings and have been largely replaced by non-metal slings.

Non-metal industrial slings can be made of natural or synthetic materials (especially those made of standard or high tenacity core yarns). Non-metal slings made of synthetic materials are usually called synthetic slings.

There are a number of methods of manufacturing non-metal slings, but the most efficient methods devise a way to form the load-bearing core into a substantially "endless" loop in which the ends of the cover are sewn together forming substantially a ring (and is usually referred to as an endless cover). Such non-metal or synthetic slings have the general shape of a ring and are called "roundslings."

Thousands of roundslings are being used on a daily basis in a broad variety of heavy load-lifting applications which range from ordinary construction, plant and equipment operations, to ship building (e.g., oil rigs), nuclear power plants and the like. The lifting core fibers of such roundslings may be derived from natural or synthetic materials, such as polyester, polyethylene, nylon, and the like.

An advantage of synthetic slings is that they have a very high load-lifting performance (i.e., a high strength-to-weight ratio) which results in lighter, more flexible and even stronger slings than the heavier, relatively inflexible metal slings.

Non-metal industrial slings are comprised of a load-bearing core inside an elongated, tubular cover. The core bears the entire weight of the load to be lifted while the cover's sole function is to protect the core from physical damage and environmental exposure.

The cover protects the entire length of the core from damage. The cover not only protects the core from direct physical damage, such as sharp edges from the load and other objects that may come in contact with the sling, but also protects the core from molecular damage (e.g., chemicals/acids, ultraviolet degradation caused by sunlight, environmental pollutants, excessive heat under working conditions, etc.).

The load-bearing core of a synthetic sling is made of a number of core yarns (sometimes called core strands). Each core yarn is made of a plurality of threads.

Sling manufacturers of prior art synthetic slings wind the core yarns into an endless loop in which each run or loop of the core yarn is substantially parallel to every other loop (this may be referred to as load-bearing core having core yarns laid straight). The winding is usually performed on a machine having a motor-driven roller and a free-rolling roller set a specific distance away from the motor-driven roller. During the manufacturing process, the cover is "bunched" together in accordion-like fashion, and the core yarns are run straight through the cover. The distance between rollers is determined by the desired length of the sling to be made.

Before a sling manufacturer begins making a sling, it must know how much weight the sling needs to support (i.e., the rated load), determine how much force or weight each individual core yarn can support, then calculate how many loops are needed to make the load-bearing core for the rated load. Many factors can impact these calculations including the type of material selected for the core yarns, the diameter of the yarns, the diameter of the threads used to make the core yarns, etc.

Non-metal slings are not without their own unique problems. It has been discovered that this method of manufacturing results in loops of core yarns that are of slightly different lengths. Therefore, when a prior art non-metal sling is placed under load, the force of the load is borne by the shortest loops of core yarn. In other words, a load-bearing core is designed to have "X" number of core yarns to be able to life the rated load, but only a fraction of the "X" number of core yarns bear the weight of the load because of the differences in lengths of each loop. This prior art configuration can result in the shortest loops being damaged because they are overloaded until they eventually break. When the shortest loops of core yarns break, the next shortest loops of core yarns support the load until they too are damaged and eventually break, and so on until the synthetic sling suffers a catastrophic failure.

In order to prevent a catastrophic failure, synthetic slings must be constantly inspected and/or tested to ensure that they continue to meet the load they are rated to support. If damage to the load-bearing core is discovered, the sling is removed from service and destroyed.

SUMMARY OF THE INVENTION

The present invention describes a non-metal sling and, in particular the relationship between the load-bearing core and the cover of said sling. The core bears all of the weight of the load to be lifted and is preferably made of a plurality core yarns wound in a continuous loop. The cover protects the load-bearing core. The cover is preferably manufactured as an elongated tube whose ends are sewn together after the load-bearing core is formed.

Until recently, when an inspection of a synthetic sling uncovers damage to the load-bearing core, it was assumed that the sling was subjected to an overload condition. However, it is now believed that a common cause of damage to a synthetic sling is a result of the manufacturing process. As described previously, the lack of uniformity in length in the loops of core yarns that form the load-bearing core results in the shortest loops bearing the entire load, while the longest loops have virtually no load. Over time, the shortest loops fail, and the load is borne by the next shortest loops of the load-bearing core. This process, if allowed to progress, will eventually lead to the failure of all loops and a complete failure of the load-bearing core.

Applicant has found that twisting the loops of core yarns in a helical pattern results in a 12-15% increase in strength of the load-bearing core. In other words, with no other changes other than twisting the load-bearing core yarns, a sling achieves a significant increase in the weight of the load the sling can lift. Alternatively, a sling manufacturer that twists the core yarns can use 12-15% less core yarns to make a sling having the same load rating as a sling with substantially parallel or untwisted loops of core yarns.

The problem with twisting the core yarns in a helically-laid bundle is to invent a machine or a method that can perform this twisting in an efficient and cost-effective manner. U.S. patent application Ser. No. 11/981,110 discloses a machine that efficiently twists the core yarns during the manufacturing process. An important feature of the machine disclosed in the '110 application is that the core yarns can be fed through the cover without bunching the cover in an accordion-like fashion; also, it is preferred to lock the roller opposite the motor-driven-roller preventing it from rotating (or even eliminate the tail roller all together). The present invention describes a method to efficiently twist the core yarns during the manufacturing process.

Each core yarn is made up of a plurality of threads; preferably, these threads are twisted together. When an individual core yarn is made, the threads may be twisted together in a left-lay (called an "S" twist) or a right-lay (called a "Z" twist), or they may not be twisted. Prior art non-metal slings are not twisted.

The cover of the sling may be woven from fibers in a left-lay, right-lay or with no lay. When the core yarns are formed with threads twisted in one lay/direction (e.g., an S twist), and the cover is woven in the opposite lay/direction (e.g., a Z twist), and the core yarns are forced into the cover during the winding step of the manufacturing process, the friction between the plurality of core yarns rubbing against the inside of the cover forces the loops of core yarns to twist about each other forming a helically-laid strand.

The present invention discloses the method of twisting the core yarns together by inserting a plurality of core yarns, each made from threads twisted in one direction, into a cover made from fibers with a twist in the opposing direction. As the core yarns are inserted into the cover, the interaction between the opposing twist directions results in the core yarns twisting in a helically-laid bundle.

Testing has shown that a load-bearing core made from core yarns twisted together offers greater strength than a load-bearing core made from yarns that are not twisted together. Although it is known to twist wire strands together to make wire rope, Applicant knows of no prior art synthetic slings manufacture that twist their core yarns. The subject method of twisting core yarns is a vast improvement over previous methods of twisting wire strands that involve specialized machinery. These special machines include using a spinning wheel with holes where the wire strands of the core material go through. The present invention avoids the requirement of specialized machinery and complicated methods with a novel method of twisting the core material. Previous to this invention, there was no way to twist the core material without the adoption of special machinery.

BRIEF DESCRIPTION OF THE DRAWINGS

The accompanying drawings, which are incorporated in and form a part of the specification, illustrate the embodiments of the present invention and, together with the following description, serve to explain the principles of the invention. For the purpose of illustrating the invention, there are shown in the drawings embodiments which are presently preferred, it being understood, however, that the invention is not limited to the specific instrumentality or the precise arrangement of elements or process steps disclosed.

In the drawings:

FIG. 3*a* illustrates a right regular lay;

FIG. 3*b* illustrates a left regular lay;

FIG. 3*c* illustrates a right lang lay;

FIG. 3*d* illustrates a left lang lay;

FIG. 3*e* illustrates a right alternate lay;

DETAILED DESCRIPTION OF THE PREFERRED EMBODIMENT

In describing a preferred embodiment of the invention, specific terminology will be selected for the sake of clarity. However, the invention is not intended to be limited to the specific terms so selected, and it is to be understood that each specific term includes all technical equivalents that operate in a similar manner to accomplish a similar purpose.

Synthetic slings have gained popularity over the last twenty years and are replacing metal slings in many circumstances. Synthetic slings are usually comprised of a lifting core made of a plurality of yarns or strands of synthetic fiber and an outer cover that protects the core. Each individual core yarn is, in turn, made from a plurality of threads. The cover is manufactured from a plurality of fibers.

The most popular design of synthetic slings is a roundsling in which the load-bearing core is formed from a plurality of core yarns formed in a continuous loop (in a substantially parallel configuration) resulting in a sling that has a circular or oval-shaped appearance.

Preferred embodiments of the present invention will now be described in detail with reference to the accompanying drawings.

Figure 1:
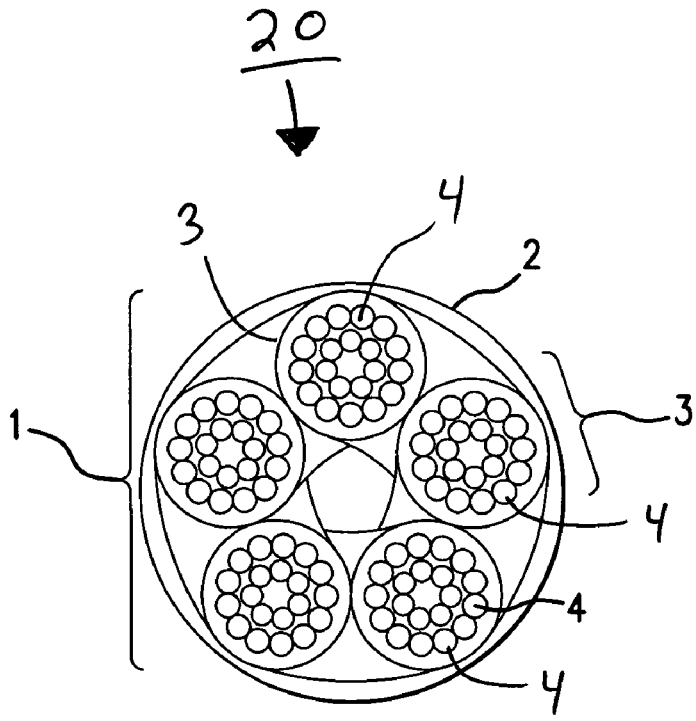
FIG. 1 is a cross-sectional view of a sling made in accordance with the present invention.

Referring to FIG. 1, a synthetic sling 20, in accordance with the present invention, is comprised primarily of a load-bearing core 1 and an outer cover 2. The cover 2 protects the load-bearing core from abrasion and from environmental conditions (e.g., exposure to acid, exposure to sunlight, or exposure to ultraviolet radiation, etc.).

The load-bearing core 1 is comprised of a plurality of core yarns 3. Each core yarn 3 is made of a plurality of threads 4.

The cover 2 is made by a machine in a separate process from a plurality of synthetic fibers. The material used for the fibers are chosen for the type of environment the sling will be used in. For example, if the sling will be used in an environment having high temperatures (e.g., an iron smelting plant) the material used for the fibers to make the cover will be different than the materials used for the fibers if the sling will be used in a chemical plant that makes acids. Similarly, a sling that is used on an off-shore oil platform will have a cover made from different fibers that can withstand ultraviolet rays and salt water. However, almost all covers 2 are manufactured with either a right-lay or a left-lay.

The present invention discloses a load-bearing core 1 with a specific twist and its relationship/interaction with a cover 2 manufactured from fibers twisted in the opposite direction. A sling 20 manufactured in accordance with the present invention offers greater strength than a sling with a load-bearing core with no twist. In addition, this invention discloses a method of manufacturing that greatly reduces the time and expense of manufacturing an improved sling. Testing has proved that a sling made in accordance with this invention has significantly more strength from a sling made from conventional methods using the same amount of material; this allows either a stronger sling or a sling of the same strength with less material than conventional slings made with conventional covers.

The load-bearing core 1 is encased by the cover 2 which runs the length of the sling. The load-bearing core 1 bears the entire load when the sling is used to lift, move or tow an object. No weight is supported by the cover.

The present invention involves the formation of a synthetic sling 20 having a helically-laid load-bearing core 1 and, more specifically, the relationship between individual core yarns 4 and the cover 2 during the manufacturing process of the sling. The present invention also covers the method of forming the sling.

Many manufacturers of synthetic slings purchase their core yarns from a third-party vendor. The sling manufacturer will specify the type of materials used to manufacture the core yarns. If the third-party vendor makes its core yarns without twisting the individual threads, then the resulting core yarn will not have a lay. If the third-party vendor twists the individual threads, the core yarn will have either a left-lay or a right lay. Almost all third-party vendors manufacture their core yarns by twisting the threads during the manufacturing process.

Similarly, sling manufacturers usually purchase the covers from third-party vendors or manufacture the covers in a separate process before manufacturing a sling. The cover can be made from fibers such that the cover has a left-lay, a right-lay or no lay.

Manufacturers of synthetic slings use a machine that feeds a plurality of core yarns into the cover. The most common machines hold the cover in a "bunched up" or accordion-like fashion such that it forms a straight tube and force the core yarns through the cover. The bunched cover does not touch either the motor-driven roller or the free-spinning tail roller. Once the desired number of loops of core yarns are run through the cover, the ends of the yarns are spliced together and the cover is "unbunched" to encase the entire ring of the load-bearing core. This type of machine is sometimes referred to as the "European" machine.

A machine to manufacture slings is disclosed in U.S. patent application Ser. No. 11/981,110, now U.S. Pat. No. 7,568,333, titled SLING MAKING MACHINE by Dennis St. Germain. U.S. patent application Ser. No. 11/981,110 (now U.S. Pat. No. 7,568,333) is hereby incorporated by reference as if fully set forth herein. A primary difference of the machine disclosed in the '110 application, is that the cover is almost completely extended in an oval shape (i.e., the cover is not bunched together) and the core yarns are run through the entire length of the cover.

Regardless of the machine used to manufacture a synthetic sling, during the manufacturing process, the core yarns rub against the inside of the cover. However, there is much more friction between the core yarns and the cover when using the machine disclosed in U.S. application Ser. No. 11/981,110. The present invention takes advantage of the friction between the core yarns and the inside of the cover during the manufacturing process.

Figure 2:
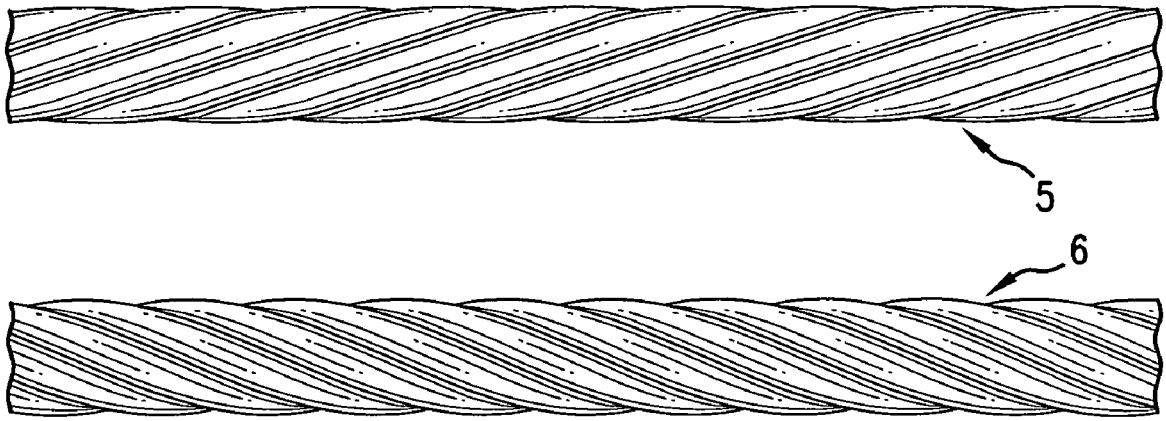
FIG. 2 is an enlarged view of individual core strands having a left-lay (i.e., an "S" twist) and a right-lay (i.e., a "Z" twist)

Referring now to FIGS. 2 and 3, the present invention involves different parts of the sling, each having a twist. First, a single core yarn 3 can be made from individual threads 4 having a left-lay ("S" twist) 5 or right-lay ("Z" twist) 6. The best mode of the invention has an individual core yarn with a S twist. Second, the fibers used to weave the cover can have three possible configurations, a S twist, a Z twist, or no twist.

The important feature of this invention is that the core yarns 3 have the opposite lay when compared to the fibers used to weave the cover 2. The interaction of the core yarns 3 with the inner side of the cover 2 during the manufacturing process causes the resulting load-bearing core 1 to form in a helically-laid bundle. The lay of the load-bearing core depends on the lay of the core yarns 3 and the lay of the fibers of the cover 2. The interaction between the various surfaces is especially acute when using the machine disclosed in U.S. patent application Ser. No. 11/981,110, now U.S. Pat. No. 7,568,333. In a preferred embodiment, the core yarns 3 have an S twist and the fibers in the cover 2 have a Z twist; this configuration results in a sling with a load-bearing core having a S twist.

In another embodiment of this invention, the core yarns 3 have a Z twist and the fibers in the cover 2 have a S twist; this configuration results in a sling with a load-bearing core having an Z twist.

When the plurality of core yarns 3 having a specific lay are pulled through the cover 2 having the opposing lay, the friction of the core yarns moving past the cover results in the core yarns twisting about each other during the formation of the load-bearing core. The loops of core yarns form a helically-laid load-bearing core. The resulting synthetic sling is capable of bearing more weight than other slings that do not have twisted load-bearing core yarns.

Accordingly, a synthetic sling made according to the subject disclosure with the same amount of core yarns will be stronger than a sling that does not use twisted core yarns. Alternatively, a sling made according to the subject disclosure can be made from less material to produce a sling with the same load-bearing rating as a sling that does not have helically-twisted core yarns.

It is known in the art of wire-rope slings to twist the metal wires together. Various methods exist to force the wire's strands to twist together which include using a spinning wheel with holes where the individual wire stands are fed through. However, it has been shown that a similar method does not work with synthetic yarns because the synthetic yarns do not have the rigidity of the wire strands. Previous to this invention, there was no way to twist the synthetic core yarns together without special machinery and substantial input of time.

As set forth in a publication printed by the *Wire Rope Technical Board—Wire Rope Users Manual*, Fourth Edition, page 9, wire rope is identified not only by its component parts, but also by its construction, i.e., by the way the wires have been laid to form strands, and by the way the strands have been laid around the core.

Figure 3A:
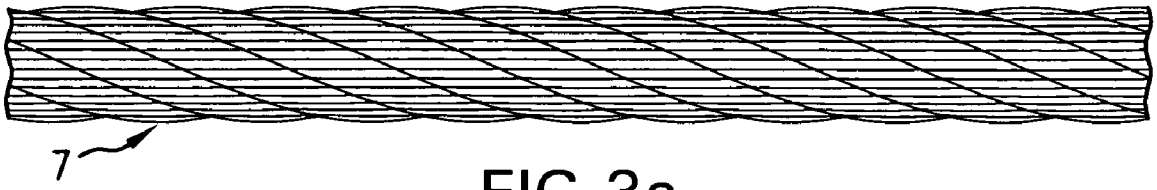
FIGS. 3*a*-3*e* illustrate variations of typical wire rope lays.
Figure 3B:
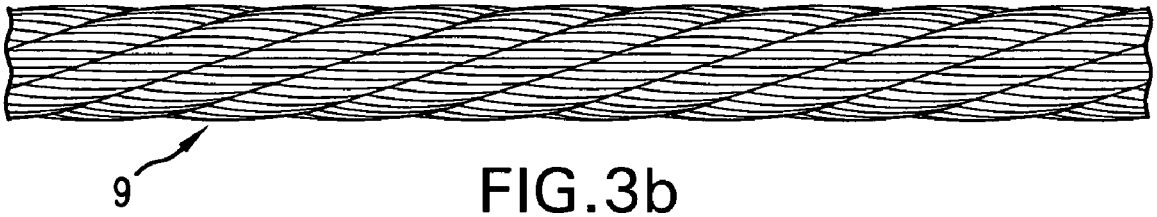
Figure 3C:
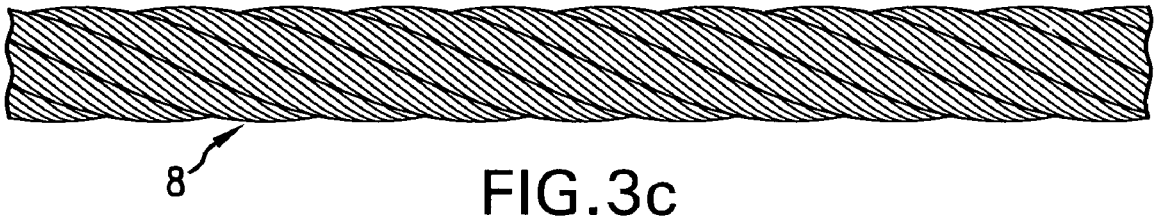
Figure 3D:
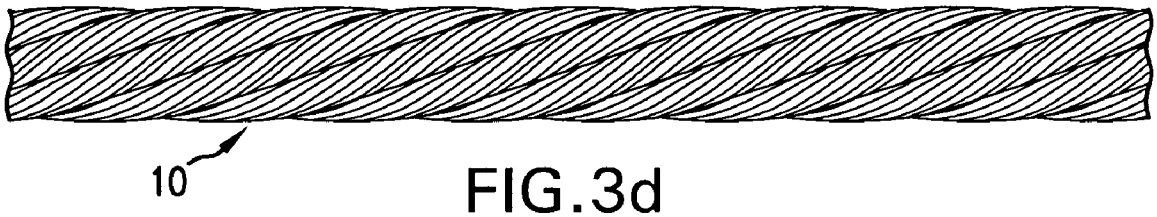
Figure 3E:
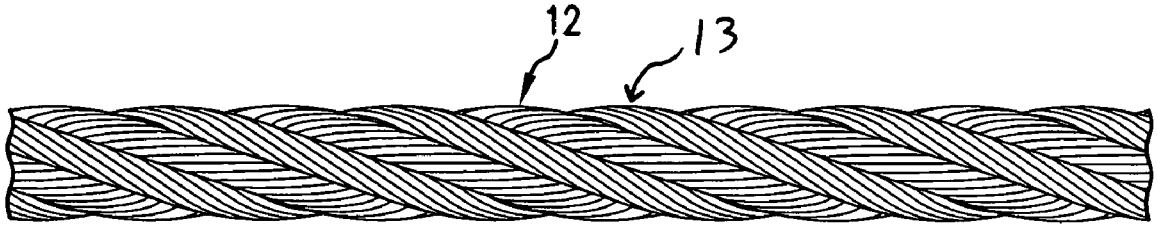

FIGS. 3*a* and 3*c* show a right lay rope. Conversely 3*b* and 3*d* show a left lay rope.

Again in FIG. 3, the first two illustrations (3*a* and 3*b*) show regularly lay ropes. Following these are the types known as lang lay ropes (3*c* and 3*d*). Note that the wires in regular lay ropes appear to line up with the axis of the rope; in lang lay ropes the wires form an angle with the axis of the rope. This difference in appearance is a result of variations in manufacturing techniques: regular lay ropes are made so that the direction of the wire lay in the strand is opposite to the direction of the strand lay in the rope; lang lay ropes are made with both strand lay and rope lay in the same direction. Finally 3*e* called "alternate lay" consists of alternating right and left lay strands.

Preliminary testing has shown that there is no significant difference when manufacturing the core strands using a right regular lay versus a right lang lay. As stated previously, the important factor is that the lay of the core yarns be in opposition to the lay of the fibers in the cover.

Referring again to FIG. 3*e*, the non-metal equivalent is to have load-bearing core's strands twisted together in an S twist 12 alternating with immediately adjacent individual core strands having a Z twist 13. By using the alternate lay configuration for the core strands, it has the benefit of allowing the core strands 3 to interact with a cover that has either an S twist or a Z twist. This is an important feature since cover manufacturers are not aware of the effect the particular lay of the cover fibers can have on the manufacturing of a sling. Accordingly, a sling manufacturer can buy covers from any manufacturer and ensure that the load-bearing core will result in a helically-laid bundle regardless of the lay of the fibers used to make the cover.

Core strands that are twisted together can bear heavier loads than core strands that are not twisted. The present invention is not limited to any specific rate of twisting of either the individual core yarns, the helically-shaped load-bearing core, or the cover. Any number of revolutions per unit of length (e.g., twists per foot) are encompassed in this invention.

The core strands twisted together and the cover may have a rate of twisting that is about the same. However, the present invention envisions a sling where the core yarns twisted together have more revolutions than the cover. The present invention also envisions a sling where the core yarns twisted together have less revolutions than the cover.

The best mode of present invention is where an individual core strand is made of either one specific synthetic material, including high molecular weight polyethylene, high modulus polyethylenes (HMPE), high performance polyethylenes (HPPE), aromatic polysters (e.g., liquid crystal polymers (LCP)), para-aramids (e.g., Kevlar®) and occasionally from other types of synthetics or a combination of synthetic materials, and the cover is made of a nylon or other synthetic yarn. However, the present invention is not limited to specific materials. Other possible materials of which the core strand could be made of include: synthetic fibers, natural fibers, metallic fibers, a combination of syntheic and metallic fibers, a combination of synthetic and natural fibers, or a combination of all three fibers.

Figure 4:
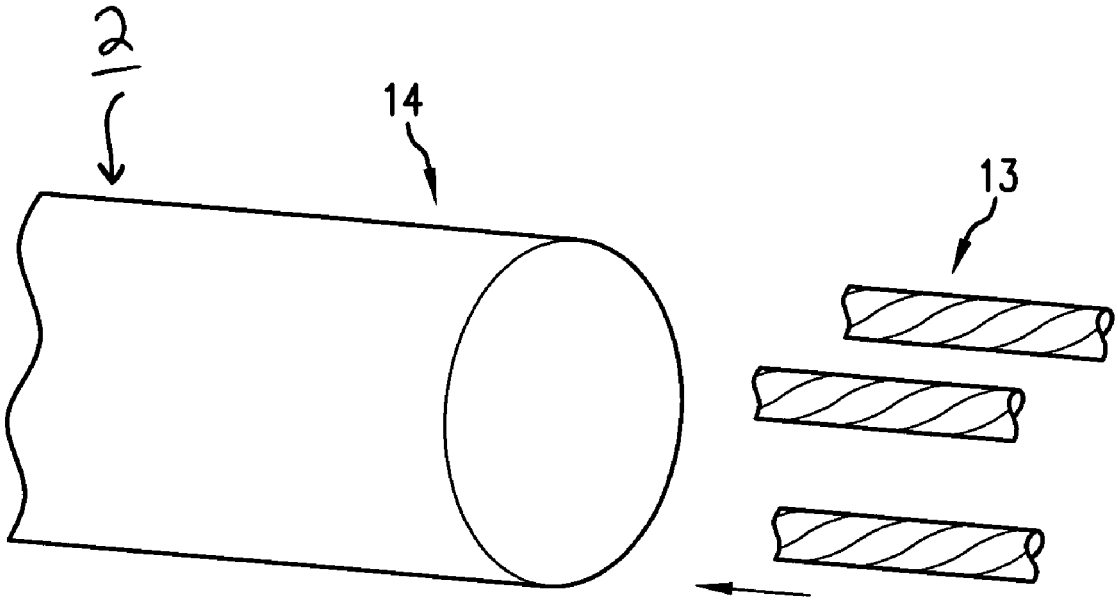
FIG. 4 is an illustration of the core strands being inserted into a cover.
Figure 5:
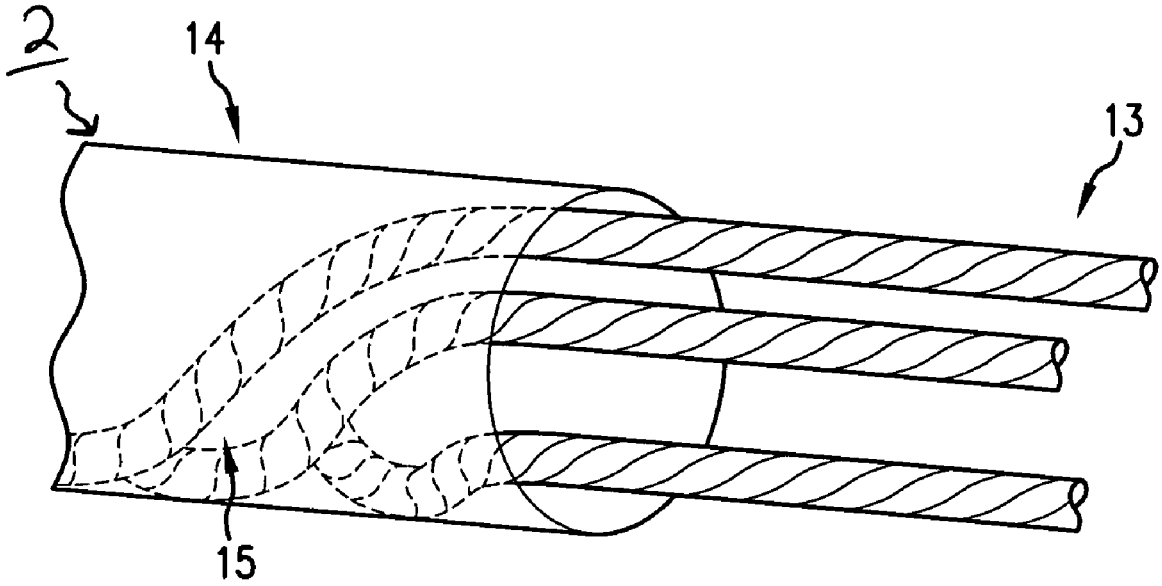
FIG. 5 is an illustration of several core strands twisting by interacting with the cover.

The present invention uses the interaction between the core yarns used to make the load-bearing core and the cover to twist the core strands together—and with an appropriate amount of twist per foot. A person skilled in the art, after reading the present disclosure, would understand that by changing the rate at which the core yarns are fed into the cover, changing the diameter of the cover (which changes the amount of friction between the core yarns and the interior of the cover), changing the number of core yarns used to manufacture the load-bearing core, changing the thickness of the threads used to make the individual core yarns, or making other modifications, a sling manufacturer can adjust the number of twists per foot of the helically-shaped loading-bearing core. Specifically, with regards to FIGS. 4 and 5, core strands with a lay in one direction 13 are inserted into a cover 2 woven from fibers with a lay in the opposing direction 14. Before being inserted, the core strands are substantially parallel to each other as illustrated in FIG. 4. As the core strands are pulled into the cover, the directional twist of the cover interacts with the twist of the individual core strands. This interaction is caused by the friction of the opposing directional twists against each other. This interaction results in the core yarns twisting about each other, and the resulting twist is in the same direction as the individual core strands 15. It is believed that the step of inserting the core strands into the cover forcing the core strands to twist together is similar to how a grooved interior of a gun barrel forces a bullet to twist. Accordingly, the apparatus may be referred to as a "rifled" cover.

Since cover manufacturers do not care (or had no reason to care) about the lay of the fibers used to make the cover, a preferred embodiment of the invention envisions core strands having adjacent yarns alternatively between a Z lay and an S lay being inserted into a cover with either lay, rifling the load-bearing into a helical configuration core.

An important feature of this invention is that the interaction of the twist of the cover 2 and the twist of the individual core strands 3 causes the core strands to twist together in a specific manner to form the helically-laid load-bearing core 1 of the sling; no other force needs to be exerted on the core strands during the sling manufacturing process other than the friction created when the core strands are fed into the cover during the making of the load-bearing core.

Although this invention has been described and illustrated by reference to specific embodiments, it will be apparent to those skilled in the art that various changes and modifications may be made which clearly fall within the scope of this invention. The present invention is intended to be protected broadly within the spirit and scope of the appended claims.

I claim:

1. A method of making a synthetic sling comprising the steps of:

providing an elongated tubular cover manufactured from threads having a twist in a first direction; and inserting a plurality of core strands into said cover wherein each core strand has a twist in a second direction opposing said twist direction of the threads forming the cover, such that the opposing twist direction force the core strands into a helically twisting arrangement that forms a load-bearing core.

2. The method of claim 1 where the twist of the core strands is in the Z direction, the twist of the threads that form the cover is in the S direction, and the overall helical twist of the load-bearing core is in the Z direction.

3. The method of claim 1 where the twist of the core strands is in the S direction, the twist of the threads that form the cover is in the Z direction, and the overall helical twist of the load-bearing core is in the S direction.

4. The method of claim 1 where the twisting of the core yarns together is caused by the interaction of the twist of each core strand and the twist of the threads used to manufacture the cover.

5. The method of claim 1 where the twisting of the core strands together is caused by the friction between the directional twist of each core strand and the opposing directional twist of the threads in the cover.

* * * * *